US008747185B1

(12) United States Patent
Evans, Sr.

(10) Patent No.: US 8,747,185 B1
(45) Date of Patent: Jun. 10, 2014

(54) BRASSIERE JEWELRY ITEM

(76) Inventor: Stephen A. Evans, Sr., Abita Springs, LA (US)

( * ) Notice: Subject to any disclaimer, the term of this patent is extended or adjusted under 35 U.S.C. 154(b) by 0 days.

(21) Appl. No.: 13/465,801

(22) Filed: May 7, 2012

Related U.S. Application Data

(60) Provisional application No. 61/483,394, filed on May 6, 2011.

(51) Int. Cl.
*A41C 3/14* (2006.01)
*A41C 3/00* (2006.01)

(52) U.S. Cl.
USPC ..... 450/41; 450/45; 450/48

(58) Field of Classification Search
USPC ..... 450/41–43, 45–48, 50–52
See application file for complete search history.

(56) References Cited

U.S. PATENT DOCUMENTS

| | | | | |
|---|---|---|---|---|
| 2,701,879 | A * | 2/1955 | Bennett | 450/52 |
| 3,312,223 | A * | 4/1967 | Wilson | 450/45 |
| 4,394,781 | A * | 7/1983 | Axmann | 2/67 |
| 5,239,841 | A * | 8/1993 | Zwart | 63/12 |
| 5,609,042 | A | 3/1997 | Williams | |
| 5,967,876 | A * | 10/1999 | Kollmanthaler et al. | 450/41 |
| 6,082,138 | A * | 7/2000 | Meehan | 63/14.8 |
| 6,758,061 | B1 * | 7/2004 | Croft | 63/14.8 |
| 6,761,613 | B2 * | 7/2004 | Utaka | 450/41 |
| 6,938,440 | B2 | 9/2005 | Smith | |
| 7,396,273 | B2 | 7/2008 | Styles-Gaviria et al. | |
| 7,677,950 | B2 * | 3/2010 | Mutschler | 450/41 |
| 7,824,242 | B2 * | 11/2010 | Perman et al. | 450/41 |
| 8,087,972 | B2 * | 1/2012 | Mutschler | 450/41 |
| 2009/0130954 | A1 | 5/2009 | Maricevic et al. | |
| 2010/0154472 | A1 | 6/2010 | Unitan | |

FOREIGN PATENT DOCUMENTS

| | | |
|---|---|---|
| DE | 29909775 | 11/2000 |

* cited by examiner

*Primary Examiner* — Gloria Hale
(74) *Attorney, Agent, or Firm* — Kenneth L Tolar

(57) ABSTRACT

A jewelry item includes an elongated, arcuate strand received within a passageway formed in the lower periphery of a brassiere cup. Any one of a plurality of interchangeable ornaments is attachable to the upper end of the strand. For example, the upper end may be inserted into a receptacle depending from a select ornament, such as a gemstone or another decorative design element. When the brassiere is worn, the ornament is suspended near one or both breasts. An alternate embodiment includes a pair of arcuate strands joined at or near their upper ends, each of which fits within a designated passageway formed around each of the brassiere cups to further anchor the ornament in a desired position.

4 Claims, 1 Drawing Sheet

BRASSIERE JEWELRY ITEM

CROSS REFERENCE TO RELATED APPLICATIONS

This application is entitled to the benefit of provisional application No. 61/483,394 filed on May 6, 2011, the specification of which is hereby incorporated by reference.

BACKGROUND OF THE INVENTION

The present invention relates to a brassiere having an integral jewelry item for accentuating a wearer's breasts.

DESCRIPTION OF THE PRIOR ART

Various body parts are often accentuated with jewelry and other adornments. However, adorning the breasts with jewelry is often challenging due to the difficulty associated with suspending an ornament near cleavage. Piercing the area is unacceptable for many people. Accordingly, there is currently a need for a jewelry item that can be quickly and easily suspended near a wearer's breasts.

A review of the prior art reveals a myriad of jewelry items, some of which are designed to accentuate a wearer's breasts. For example, U.S. Pat. No. 5,609,042 issued to Williams discloses a breast ornament including an elongated stem having a jewelry item attached to the upper end; the jewelry item is displayed by inserting the stem into a wearer's cleavage or by securing it to a bra strap using a pin, button or clip.

U.S. Pat. No. 6,938,440 issued to Smith discloses a jewelry display kit comprising a horizontal and a vertical strand of gemstones adapted to be coupled with a clothing item, such as a thong or bra.

U.S. Pat. No. 7,396,273 issued to Styles-Gaviria et al. discloses bra straps constructed with decorative beads.

U.S. Pat. No. 7,677,950 issued to Mutschler discloses a decorative breast clasp including an arcuate band that is anchored in the crease formed beneath a female breast.

U.S. published patent application no. 20100154472 on behalf of Unitan discloses a display device for a brassiere of the type having a band extending between the cups. Securable to the band is a strap having a mechanism at a distal end for displaying a message or image.

U.S. published patent application 20090130954 filed on behalf of Maricevic et al. discloses a decorative bra strap.

German patent publication DE 29909775 to Triumph International AG discloses a bra having a pocket under each cup for accommodating a wire to shape and support a wearer's breasts.

As indicated above, several jewelry items attachable to brassieres exist in the prior art. Although the patent issued to Williams discloses an ornament for accentuating breasts, it is mounted on a stem that is inserted into cleavage or is alternatively fastened to the front brassiere strap. Therefore, the ornament is easily shifted, displaced or dislodged by casual contact.

The present invention overcomes the disadvantages of the prior art by providing a jewelry item formed of at least one elongated, arcuate strand that fits within a passageway formed around the lower periphery of a brassiere cup to securely suspend an ornament near a wearer's breast. The strand firmly anchors the ornament in a desired location to prevent shifting or dislodging by incidental contact.

SUMMARY OF THE INVENTION

The present invention relates to a jewelry item including an elongated, arcuate strand received within a passageway formed in the lower periphery of a brassiere cup. Any one of a plurality of interchangeable ornaments is attachable to the upper end of the strand. For example, the upper end may be inserted into a receptacle depending from a select ornament, such as a gemstone or another decorative design element. When the brassiere is worn, the ornament is suspended near one or both breasts. An alternate embodiment includes a pair of arcuate strands joined at or near their upper ends, each of which fits within a designated passageway formed around each of the brassiere cups to further anchor the ornament in a desired position.

It is therefore an object of the present invention to provide a jewelry item that accentuates a wearer's breasts.

It is another object of the present invention to provide a jewelry item that is anchored within a brassiere cup to securely suspend an ornament near a wearer's breasts.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
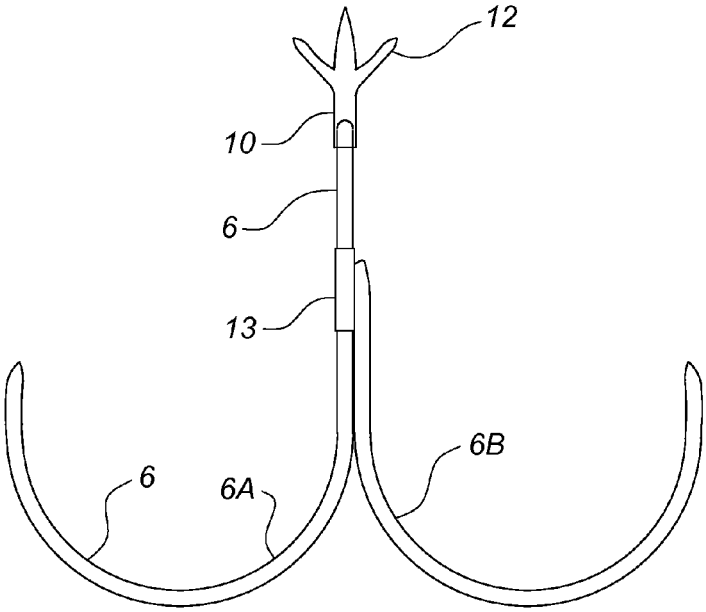
FIG. 1 is an isolated, plan view of the jewelry item according to present invention.
Figure 2:
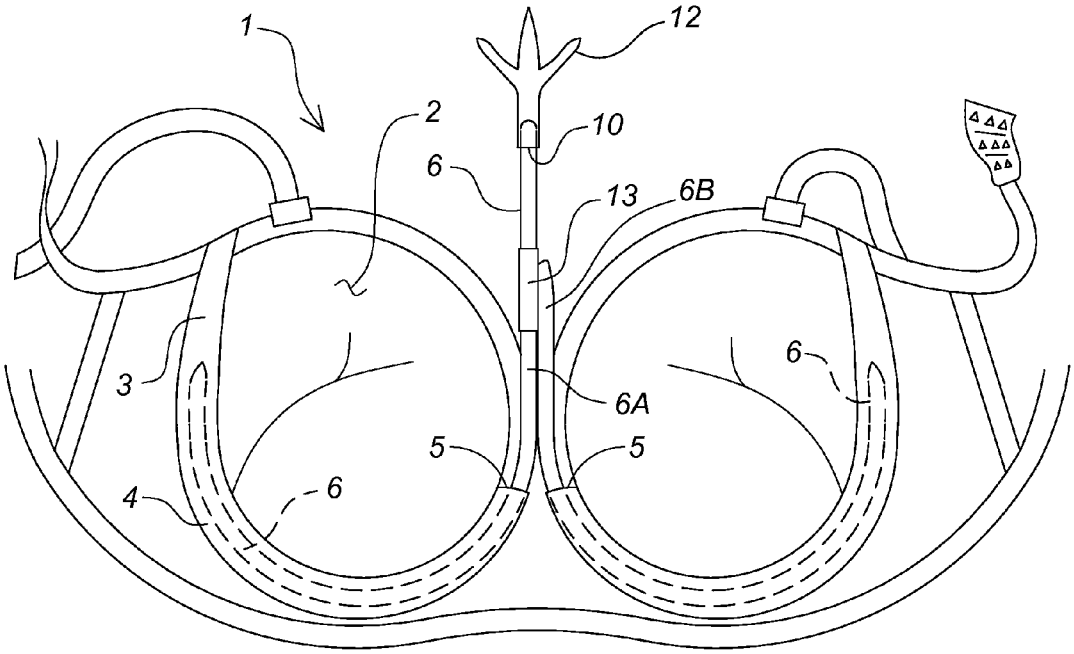
FIG. 2 depicts a brassiere with the jewelry item according to the present invention secured thereto.

The present invention relates to a jewelry item for use with a specially-designed brassiere 1 including a pair of cups 2 each having a continuous outer periphery 3. Formed in a lower portion of the periphery of one or both cups is a passageway 4 having an entrance opening 5 at an end thereof. The jewelry item according to the present invention is designed for use with the brassiere of the type described above.

The jewelry item includes at least one arcuate, tubular strand 6 received within the passageway and partially extending from the entrance opening. A distal end of the strand is adapted to accommodate any one of a plurality of interchangeable ornaments. For example, a select ornament 12, such as a gemstone or other decorative design element, may include a receptacle 10 for receiving the distal end of the strand.

To further support the ornament, the brassiere could have a passageway 4 formed around a segment of each cup; accordingly, the jewelry item is formed of a pair of arcuate strands 6A, 6B joined at or near their upper ends. Each strand fits within a designated one of the passageways formed in the brassiere cups to further stabilize the ornament in a desired location relative to the wearer's breasts. The two strands may be pivotally coupled with a sleeve 13, or a similar mechanism, to allow the cups to flex more easily while the brassiere is worn. The strands not only firmly suspend the ornament in a desired location, but also provide additional structural integrity for the cups to further lift and shape the breasts.

Accordingly, a wearer attaches a desired ornament to the strands and wears the brassiere in a conventional fashion. The ornament will be safely and securely suspended near or above the brassiere to uniquely accentuate one or both breasts.

The above-described device is not limited to the exact details of construction and enumeration of parts provided herein. The length and shape of the strands may be varied to fit within virtually any size brassiere or to position an ornament in any desired location relative to a wearer's breasts. The ornament may be interchangeably attached to one or both strands using any conventional attachment means. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A brassiere jewelry item in combination with a brassiere having a first cup with a first arcuate passageway formed around a lower periphery thereof, and a second cup having a second arcuate passageway formed around a lower periphery thereof, said brassiere jewelry item comprising:

a first tubular, arcuately shaped strand configured into the shape of said first passageway for insertion therein, said strand having a distal end; and an ornament removably attached to said distal end of said first tubular, arcuately shaped strand.

2. The jewelry item according to claim 1 wherein said ornament includes a receptacle that receives said strand distal end.

3. The jewelry item according to claim 1 further comprising a second tubular, arcuately shaped strand joined with said first tubular, arcuately shaped strand for insertion into the second passageway to provide additional structural integrity between the first brassiere cup and the second brassiere cup and to further lift and shape a wearer's breasts.

4. The jewelry item according to claim 3 wherein said first strand and said second strand are pivotally coupled to allow the first brassiere cup and the second brassiere cup to flex more easily.

* * * * *